US005739790A

United States Patent [19]

Green, Jr.

[11] Patent Number: 5,739,790

[45] Date of Patent: Apr. 14, 1998

[54] RF DOCKING ADAPTER FOR PORTABLE TRANSCEIVERS, COMMUNICATION SYSTEM AND METHOD FOR USE WITH THE SAME

[75] Inventor: Donald R. Green, Jr., San Marcos, Calif.

[73] Assignee: Nippondenso, Co., Ltd., Kariya, Japan

[21] Appl. No.: 529,723

[22] Filed: Sep. 18, 1995

[51] Int. Cl.[6] ..... H01Q 1/24

[52] U.S. Cl. ..... 343/702; 343/895; 343/901; 343/906

[58] Field of Search ..... 343/702, 901, 343/906, 876, 720, 895; H01Q 1/24, 1/10

[56] References Cited

U.S. PATENT DOCUMENTS

| | | | |
|---|---|---|---|
| 3,259,901 | 7/1966 | Bykerk | 343/906 |
| 3,702,480 | 11/1972 | Byars | 343/906 |
| 4,186,401 | 1/1980 | Altmayer | 343/906 X |
| 4,220,955 | 9/1980 | Frye | 343/720 |
| 4,525,718 | 6/1985 | Imazeki et al. | 343/702 |
| 4,868,576 | 9/1989 | Johnson | 343/702 |
| 5,302,963 | 4/1994 | Wiggenhorn | 343/702 X |
| 5,412,393 | 5/1995 | Wiggenhorn | 343/702 |
| 5,551,080 | 8/1996 | Chambers et al. | 343/906 X |
| 5,557,287 | 9/1996 | Pottala et al. | 343/702 |

FOREIGN PATENT DOCUMENTS

| | | |
|---|---|---|
| 59-28734 | 2/1984 | Japan . |
| 5243830 | 9/1993 | Japan . |

OTHER PUBLICATIONS

Journal of Nippondenso Engineering Society, vol. 49 No. 2 1995 "Next Generation Portable Cellular Telephone Development" D. J. Ponsford, pp. 47–57.

*Primary Examiner*—Donald T. Hajec
*Assistant Examiner*—Tho Phan
*Attorney, Agent, or Firm*—Cushman Darby & Cushman IP Group of Pillsbury Madison & Sutro LLP

[57] ABSTRACT

A docking adapter couples a PCS system to an external antenna via the PCS system's portable antenna. When the portable antenna is extended from the body of the PCS unit, it functions as a normal vertical dipole antenna. When it is retracted into the unit's body, a connector at the tip of the portable antenna makes electrical contact with the PCS transceiver. The tip connector may be connected to an external antenna, thereby providing a transmission path from the PCS transceiver to the external antenna.

18 Claims, 6 Drawing Sheets

RF DOCKING ADAPTER FOR PORTABLE TRANSCEIVERS, COMMUNICATION SYSTEM AND METHOD FOR USE WITH THE SAME

BACKGROUND OF THE INVENTION

1. Field of the Invention

This invention is directed to antenna systems for portable transceiver units. More particularly, it is directed to docking adapters used to connect cellular telephone units and the like to external antennas.

2. Description of the Related Art

Portable, hand-held radio frequency (RF) transceiver units such as cellular telephones and the like (collectively referred to herein as Personal Communication Service, or PCS, systems) generally include a handset unit containing a microphone and speaker, controls and internal electronics, and an antenna for RF communication with a base station or another transceiver unit. The antenna may be a relatively short, inductively loaded "rubber duckie" type antenna, or a telescoping rod type antenna.

The popularity of PCS systems stems in large part from their flexibility. Because of their portability, PCS systems can be used indoors, outdoors, or while riding in automobiles and other vehicles. When the PCS system is used in a vehicle, however, the metal vehicle body tends to act as a shield which severely limits and distorts the RF signals generated by the PCS system. Thus, it is generally necessary to use the PCS system in conjunction with an antenna external to the vehicle, such as an antenna mounted on the exterior of the vehicle body.

The use of an external antenna has additional advantages as well. For example, the external antenna need not be as portable as the PCS system antenna. Thus, there are fewer design constraints associated with it, and configurations which are better suited for a particular transceiver's operational characteristics may be used to provide higher gain. Also, it may be undesirable to expose PCS system users to the relatively high levels of RF energy generated by the transceiver, and an external antenna permits the RF signal emission point to be positioned away from users. Further, use of an external antenna avoids the need to extend the PCS system's integral antenna in the vehicle compartment, where space may be at a premium.

Connection of the PCS system to the external antenna is generally done with a docking adapter. The docking adapter has an electrical connector, such as a coaxial RF jack, which mates with a corresponding connector on the PCS system handset to establish an electrical connection therebetween. A switch on the PCS system handset is then used to switch connection of the PCS transceiver from the integral antenna to the external antenna via the docking adapter.

This approach has several disadvantages. For example, a cellular telephone should provide its user with the maximum amount of "talk time" possible. Talk time means the amount of time that the telephone can be used before its battery must be recharged; i.e., the maximum usage time between charges. A primary parameter controlling the talk time of a particular cellular unit is its transmitter efficiency; in other words, the percentage of the power supplied from the unit's battery to its transmitter which is realized as RF power transmitted from the antenna. The RF jack connection between the PCS system handset and the docking adapter and the signal path transmission lines associated with the connection introduce a significant amount of insertion loss into the system. This reduces the efficiency of the transmitter and lowers the talk time of the PCS system. Moreover, the insertion loss also results in a loss of sensitivity when the PCS system transceiver is in receive mode.

Further, the RF jack, antenna switch and associated signal transmission lines increase the size and weight of the handset, making it less portable. They also increase the number of components in the device, thereby increasing its cost and the difficulty in manufacturing it.

SUMMARY OF THE INVENTION

In view of the above problems, it is an object of the present invention to provide a system for connecting a portable transceiver to an external antenna which avoids any significant reduction in the transceiver's talk time, the efficiency of the transceiver when in transmit mode, and the sensitivity of the transceiver when in receive mode.

It is another object of the present invention to provide a system for connecting a portable transceiver to an external antenna which avoids any significant increase in the size, weight and cost of the portable transceiver.

It is yet another object of the present invention to provide a system for connecting a portable transceiver to an external antenna which minimizes the number of components in the signal path between the transceiver and the antenna.

These and other objects are realized by providing a docking adapter for PCS systems and the like which couples a PCS system to an external antenna via the PCS system's portable antenna. In a preferred embodiment of the invention, when the portable antenna is extended from the body of the PCS unit, it functions as a normal vertical dipole antenna. When it is retracted into the unit's body, a connector at the tip of the portable antenna makes electrical contact with the PCS transceiver. The tip connector may be connected to an external antenna, thereby providing a transmission path from the PCS transceiver to the external antenna.

Since the tip connector is integrated with the portable antenna structure and actuation of the external antenna connection is essentially performed by retraction of the portable antenna, only a minimal number of additional parts need be included in the PCS unit. This leads to a corresponding reduction in the size, weight and cost of the PCS system. Moreover, since the use of switches and associated transmission lines are kept to a minimum, the transceiver talk time, transmitter efficiency and receiver sensitivity may be optimized.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
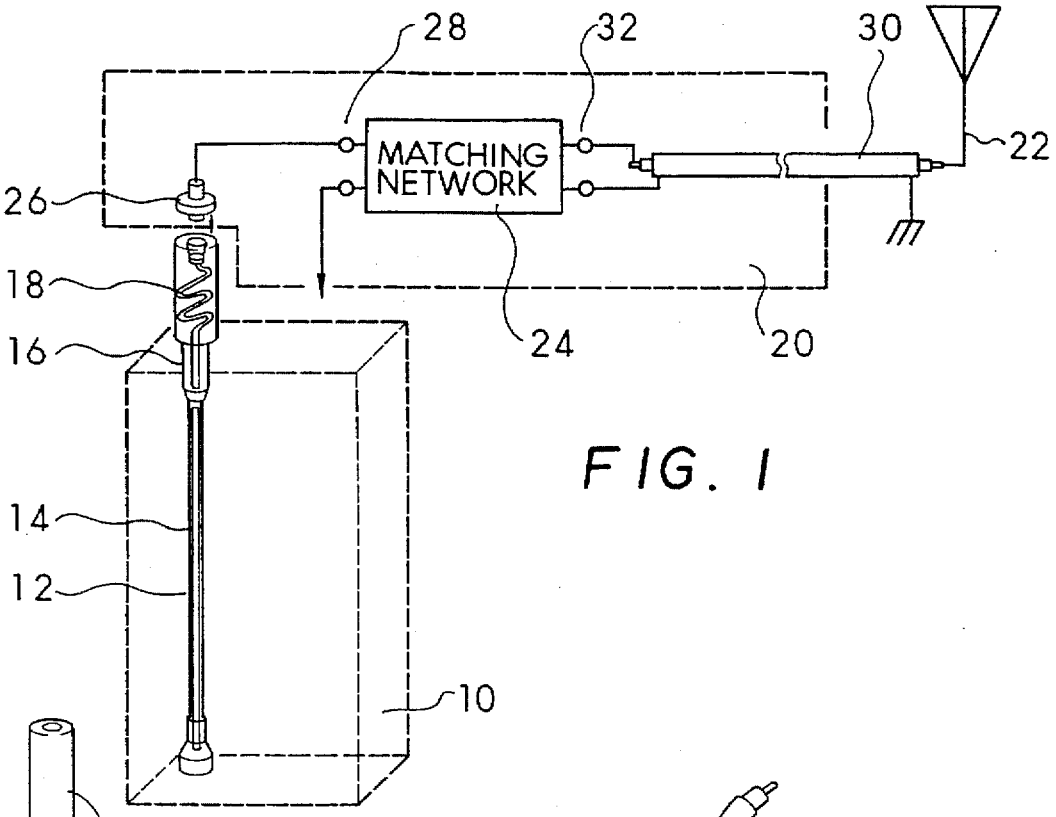
FIG. 1 is a diagram of the basic structure of the present invention.

A PCS system according to the present invention includes a unit body 10 such as a transceiver handset or the like as shown in FIG. 1. A portable antenna 12 is disposed in the body 10 and can slide in and out of the body 10 when manipulated by a user. The portable antenna 12 includes two electrically separate components, a radiating element 14 and a tip connector 16, disposed in a common insulating housing.

The tip connector 16 has two functions. First, when the portable antenna 12 is retracted, it connects to the PCS transceiver circuitry as described in greater detail below to serve as a short coil antenna with the use of an integral antenna coil 18. Second, when the portable antenna 12 is retracted, the tip connector 16 can establish an electrical connection with a docking adapter 20 connected to an external antenna 22.

The docking adapter 20 includes a matching network 24 which is connected to a docking connector 26 at its input port 28 and to the external antenna 22 via a transmission line 30 at its output port 32. The matching network 24 is used to establish an impedance-matched connection between the PCS transceiver at one end and the transmission line 30 and external antenna 22 at the other end as will be described in greater detail below.

Figure 2A:
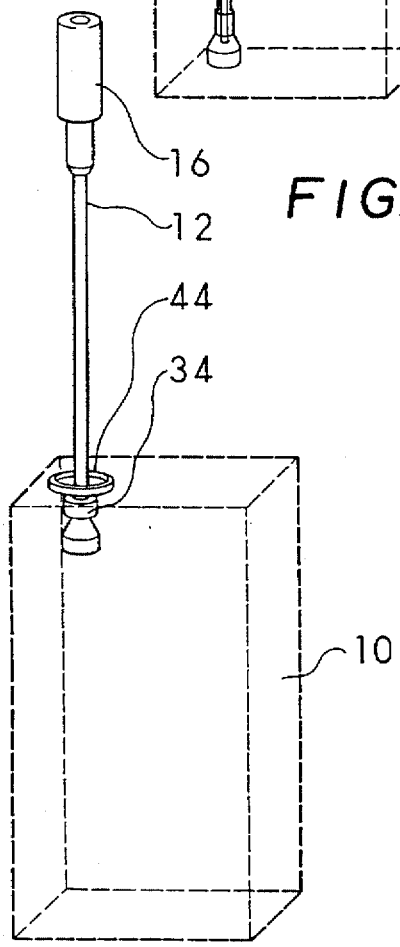
FIGS. 2A and 2B are diagrams showing operation of the invention using a portable antenna and an external antenna, respectively.

When the portable antenna 12 is extended for portable operation, the radiating element 14 passes through an annular capacitive coupling sleeve 34 (shown in FIG. 2A) connected to the PCS transceiver circuitry and establishes a capacitive connection with the sleeve 34 and with the transceiver circuitry. As noted above, the tip connector 16 is electrically separate from the radiating element 14; thus, when the portable antenna 12 is extended, it acts like a normal portable PCS antenna.

Figure 2B:
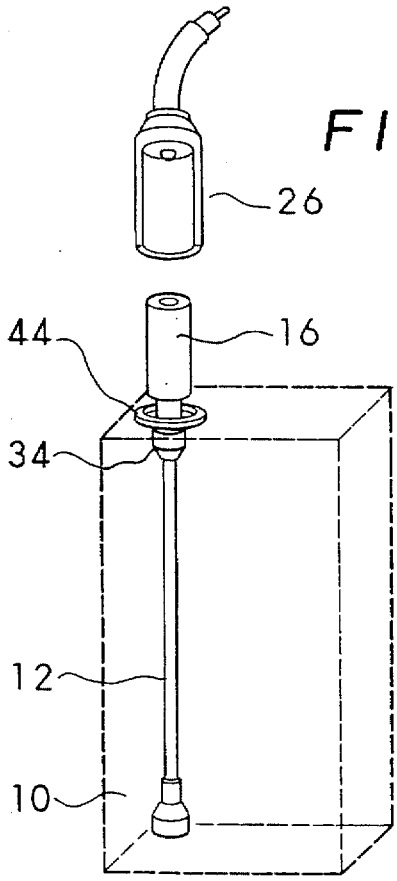
Figure 3:
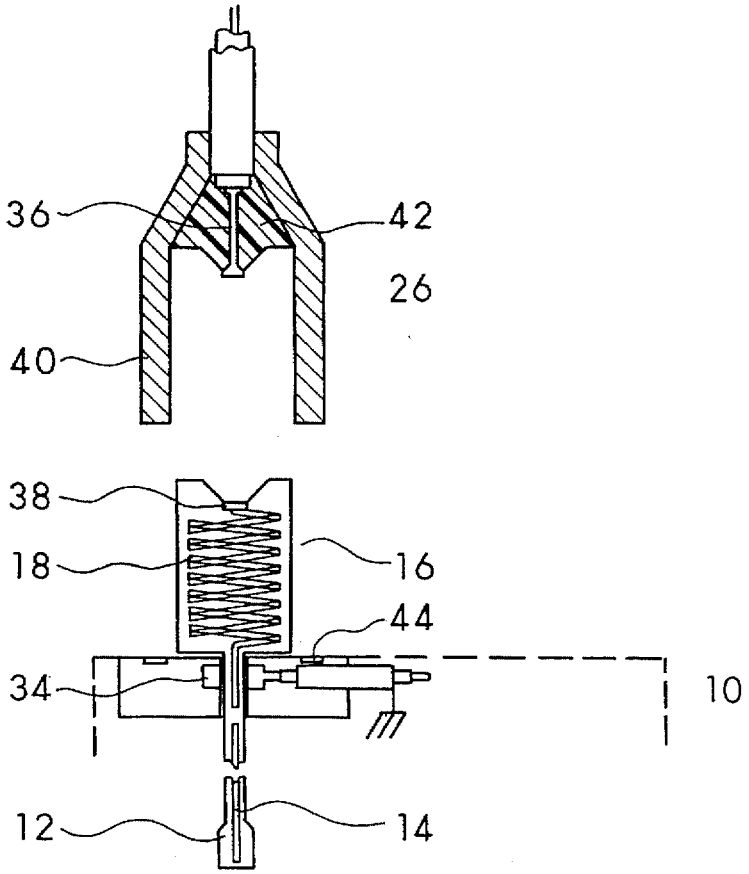
FIG. 3 is a cross-sectional view of a tip connector and docking connector according to a first preferred embodiment of the present invention.

On the other hand, when the portable antenna 12 is retracted as shown in FIG. 2B, the radiating element 14 is pulled back from the capacitive coupling sleeve 34, and FIG. 3 shows how the lower end of the antenna coil 18 passes through the sleeve 34 instead. Thus, a capacitive connection is established between the tip connector 16 and the PCS transceiver circuitry via the sleeve 34, and the antenna coil 18 functions as a loaded coil antenna for the PCS unit.

When the portable antenna 12 is retracted this way, the docking connector 26 may be fitted over the tip connector 16 to establish an electrical connection between the PCS transceiver circuitry and the docking adapter 20 via the capacitive connection between the sleeve 34 and the antenna coil 18. In this case, a center conductor 36 of the docking connector 26 makes contact with a coil terminal 38 at the upper end of the antenna coil 18, and the metal casing 40 of the docking connector 26 (separated from the center conductor 36 by an insulating spacer 42) makes a connection with a ground contact ring 44 disposed on the exterior of the PCS unit body 10. Because the ground contact ring 44 is connected to the PCS system ground as shown in FIG. 3, the docking connector casing 26 is grounded as well.

The center conductor 36 and the casing 40 are connected to the input port 28 of matching network 24 in the docking adapter 18, and the output port 32 of the matching network 24 is connected to the transmission line 30 and the external antenna 22; thus, when the portable antenna 12 is retracted and the tip connector 16 is connected to the docking connector 26, the PCS transceiver circuitry is connected to the external antenna 22 via the matching network 24 which provides impedance matching therebetween. In this configuration, the antenna coil 18 no longer functions as an antenna; rather, it is seen by the PCS transceiver circuitry as part of the antenna loading and may be advantageously treated as such.

Figure 4A:
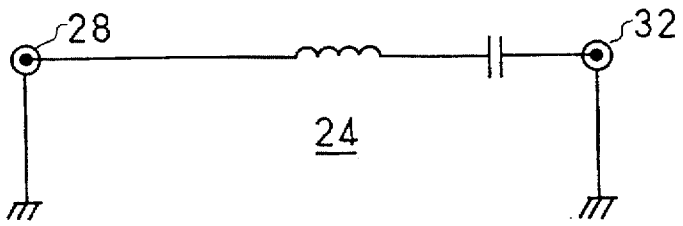
FIGS. 4A–4H are schematic diagrams of various matching networks suitable for use in the present invention.
Figure 4B:
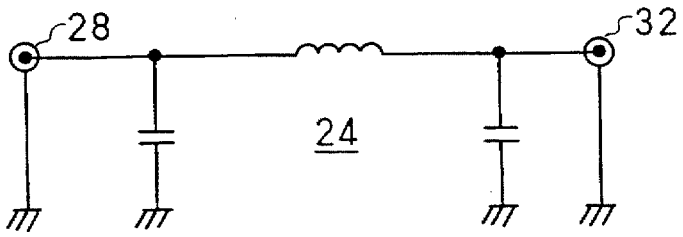
Figure 4C:
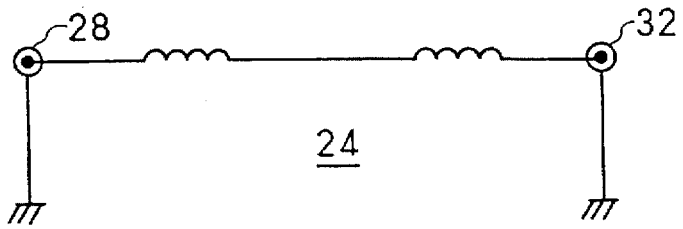
Figure 4D:
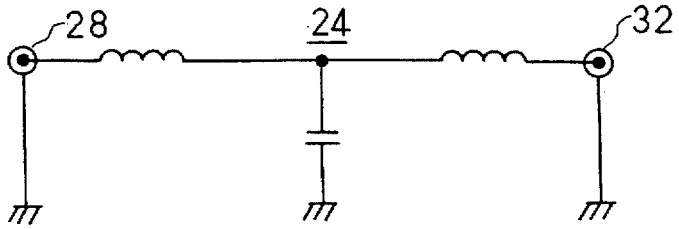
Figure 4E:
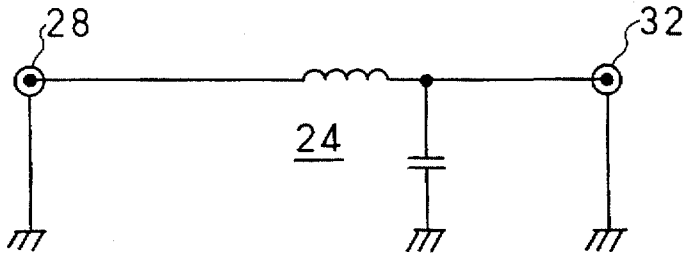
Figure 4F:
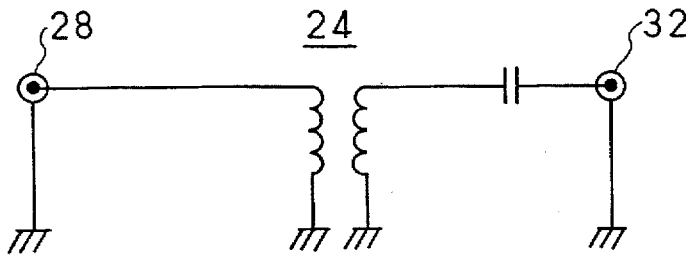
Figure 4G:
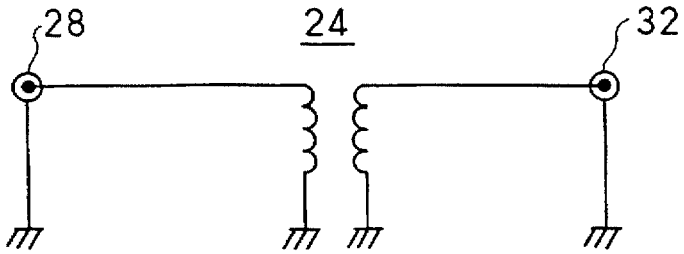
Figure 4H:
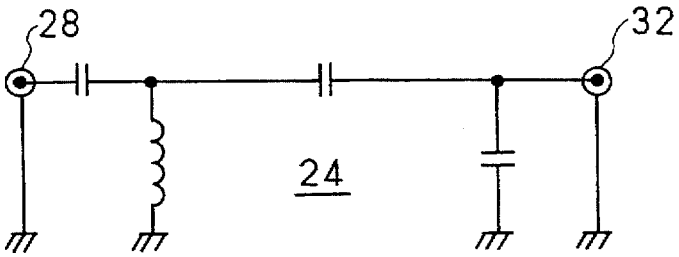

FIGS. 4A–4H show various impedance matching circuits which may be used in matching network 24, including a pi network (FIG. 4B), a tee network (FIG. 4D) and an L network (FIG. 4E). Other circuit topologies can also be used. For example, in the circuits of FIGS. 4A and 4C–4E the input port-side inductor may optionally be omitted and the antenna coil 18 used in its place, ot the two may be used in combination. Also, in each of these circuits specific component values for a particular frequency band can be calculated in a manner readily appreciated by those skilled in the art.

Figure 5:
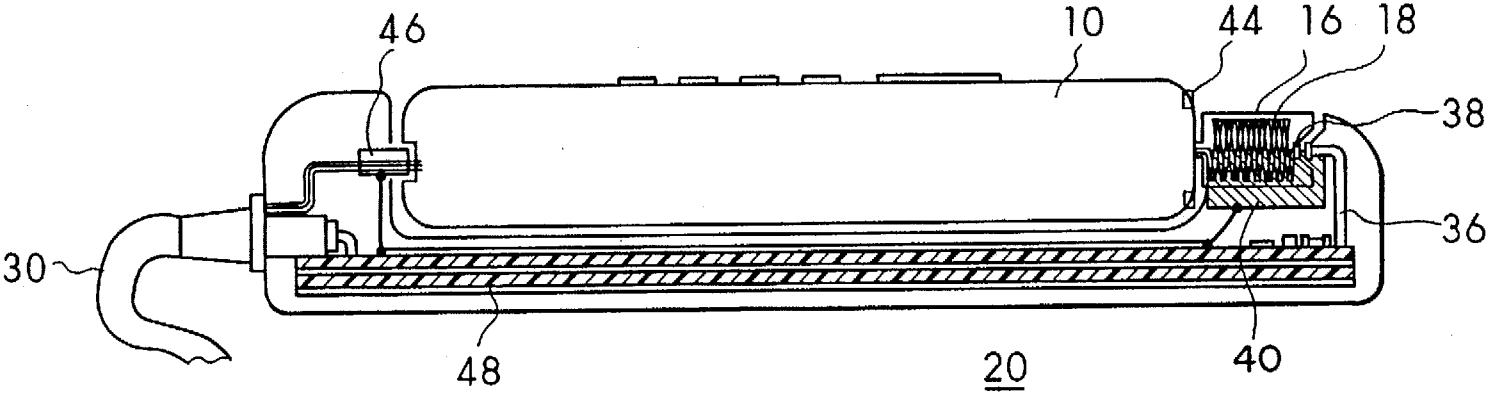
FIG. 5 is a partial cross-sectional view of the first embodiment.
Figure 8:
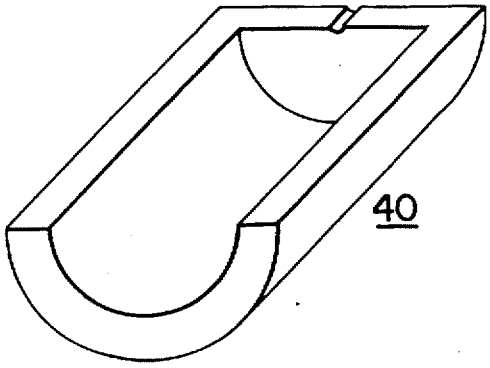
FIG. 8 shows the half-cylindrical shape of a docking connector casing in the first embodiment.

FIG. 5 shows a side view of the PCS unit body 10 mounted in the docking adapter 20 according to a typical arrangement. As shown in the Figure, the docking adapter 20 may form a hand-held cradle providing audio, control and power connections to the PCS system via a cradle connector 46, as well as providing the external antenna connection. In this arrangement, the docking connector casing 40 preferably has a half-cylinder shape (shown in FIG. 8) opening to the adapter's exterior, so that the PCS unit body 10 may be easily slipped into the cradle. Further, the matching network 24 may be disposed on a printed circuit board 48 also constituting part of the transmission line 30, as well as providing other connections between system components. Preferably, the printed circuit board 48 has three conductor layers, where the center conductor layer is used for the RF signal from the PCS transceiver.

Figure 7A:
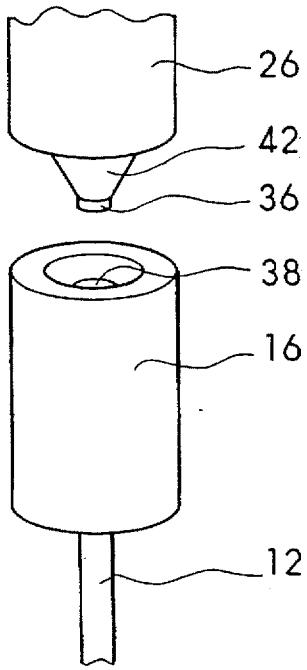
FIGS. 7A and 7B are a perspective view and a cross-sectional view, respectively, of a tip connector according to the second embodiment.
Figure 7B:
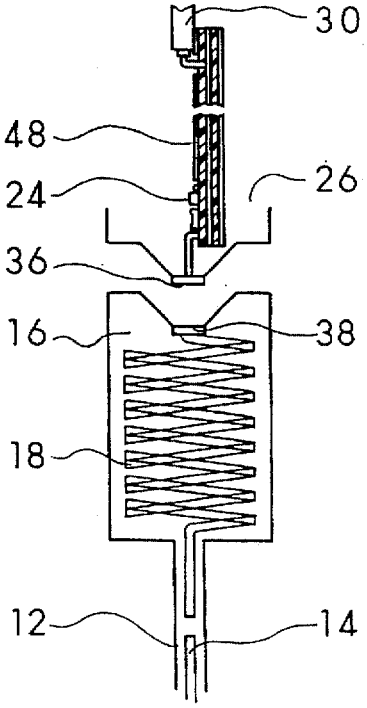
Figure 6:
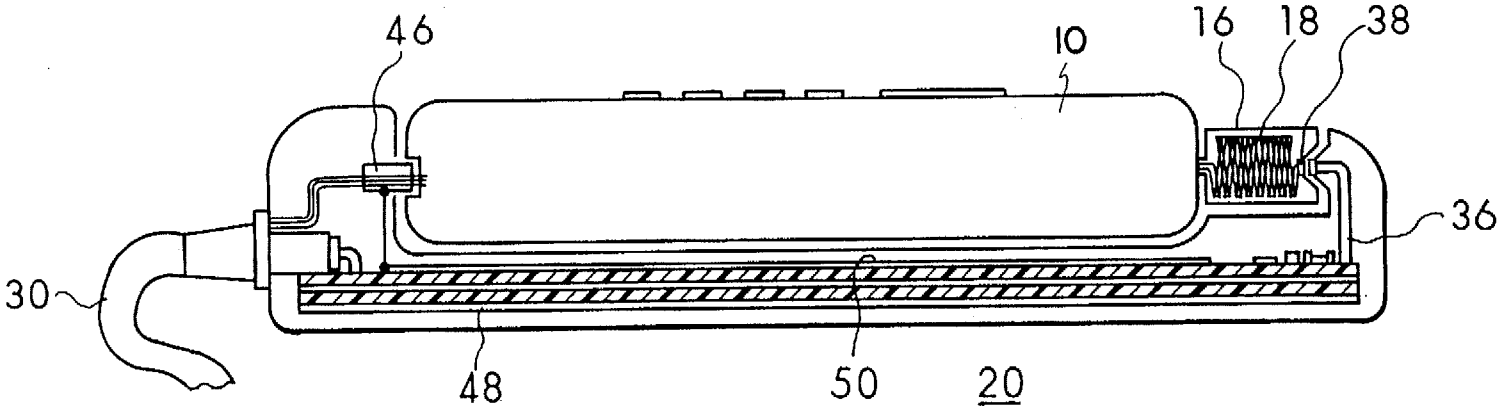
FIG. 6 is a partial cross-sectional view of a second preferred embodiment of the present invention.

To reduce the connections between the PCS system and the docking adapter 20 even further, a second preferred embodiment of the present invention replaces the connection between the docking connector casing 40 and the ground contact ring 44 shown in FIGS. 3 and 5 with a capacitive coupling between the PCS unit body 10 and a ground plane 50 of the printed circuit board 48 as shown in FIG. 6. In this way, when the PCS unit body 10 is placed in the cradle of the docking adapter 20, a ground plane within the PCS unit body 10 is in close proximity to the ground plane 50 of the docking adapter 20, and a capacitive coupling is established therebetween. Thus, the docking adapter casing 40 may be omitted from the docking connector 26 and the ground contact ring 44 similarly omitted from the PCS unit body 10 as shown in FIGS. 7A and 7B.

Although the present invention has been fully described in connection with the preferred embodiment thereof with reference to the accompanying drawings, it is to be noted that various changes and modifications will become apparent to those skilled in the art. For example:

the invention is not limited to use with PCS systems and may be used with other radio communication systems and portable communication units;

the particular direct electrical and capacitive coupling connections shown herein need not be used and a variety of suitable connection techniques may be used instead;

the matching network is not limited to circuit topologies indicated, or to providing impedance matching functions and may also be used to compensate for variations in ground connections and antenna coupling connections; and the portable antenna is not limited to use with an antenna coil, and may be directly coupled to the docking adapter.

Such changes and modifications are to be understood as being included within the scope of the present invention as defined by the appended claims.

What is claimed is:

1. A portable communication device comprising:

a unit body including electrical circuitry disposed therein;

antenna means selectively positionable relative to said unit body for in a first position relative to said unit body, functioning as an antenna to radiate energy from said electrical circuitry, and for, in a second position relative to said unit body, functioning as an electrical connector to provide an electrical connection between said electrical circuitry and an external antenna via a capacitive coupling with said electrical circuitry.

2. The device of claim 1, said antenna means comprising:

a radiating element functioning as said antenna radiating energy in said first position; and a tip connector functioning as said electrical connector and being capacitively coupled with said electrical circuitry in said second position.

3. The device of claim 2, wherein:

said antenna means is slidably disposed within said unit body;

said first position is a position when said antenna means is extended from said unit body; and said second position is a position when said antenna means is retracted within said unit body.

4. The device of claim 2, wherein:

said radiating element is capacitively coupled to said electrical circuitry in said first position.

5. The device of claim 2, said tip connector comprising an antenna coil capable of functioning as a coil antenna in said second position.

6. The device of claim 2, further comprising a capacitive coupling sleeve disposed within said unit body around said antenna means, said sleeve being in electrical contact with said electrical circuitry and establishing a capacitive coupling connection with said radiating element in said first position and with said tip connector in said second position.

7. The device of claim 2, further comprising:

a ground contact ring disposed on an exterior of said unit body in electrical contact with a ground of said electrical circuitry;

wherein said ground contact ring is adapted to make electrical contact with said external antenna in said second position.

8. The device of claim 2, further comprising:

a ground plane in said unit body connected to said electrical circuitry, said unit body ground plane forming a capacitive coupling with a ground plane connected to said external antenna in said second position.

9. A communication system comprising:

a portable communication device including a unit body including electrical circuitry disposed therein, and a portable antenna slidably disposed within said unit body to establish an electrical connection between said electrical circuitry and a radiating element in said portable antenna when said portable antenna is extended from said unit body and to establish an electrical connection between said electrical circuitry and a tip connector on an end of said portable antenna via a capacitive coupling with said electrical circuitry when said portable antenna is retracted within said unit body; and a docking adapter, capable of receiving said portable communication device, including a docking connector adapted to establish an electrical connection with said tip connector, an electrical network having an input port connected to said docking connector, a transmission line having a first end connected to an output port of said electrical network, and an external antenna connected to a second end of said transmission line, said electrical network providing an impedance match between said electrical circuitry, and said transmission line and external antenna.

10. The system of claim 9, said tip connector comprising an antenna coil capable of functioning as a coil antenna in said second position.

11. The system of claim 10, wherein said antenna coil functions as an antenna load when said tip connector is connected to said docking connector.

12. The system of claim 10, wherein a series circuit is formed by said electrical circuitry, said antenna coil, said matching network, said transmission line and said external antenna when said docking adapter receives said portable communication device.

13. The system of claim 9, wherein said docking connector has a half-cylindrical shape.

14. The system of claim 9, further comprising a capacitive coupling sleeve disposed within said unit body around said portable antenna, said sleeve being in electrical contact with said electrical circuitry and establishing a capacitive coupling connection with said radiating element when said portable antenna is extended from said unit body and with said tip connector when said portable antenna is retracted within said unit body.

15. The system of claim 9, further comprising:

a ground contact ring disposed on an exterior of said unit body in electrical contact with a ground of said electrical circuitry;

wherein said ground contact ring makes electrical contact with said external antenna when said portable antenna is retracted and said tip connector is connected to said docking connector.

16. The system of claim 9, further comprising:

a ground plane in said unit body connected to said electrical circuitry; and a ground plane in said docking adapter connected to a ground of said external antenna;

wherein said unit body ground plane and said docking adapter ground plane form a capacitive coupling with one another when said portable communication device is received in said docking adapter.

17. A method of selectively connecting a portable communication device to a plurality of antennas, said method comprising the steps of:

establishing an electrical connection between transceiver circuitry in said portable communication device and a radiating element of a portable antenna when said portable antenna is extended from said portable communication device; and establishing an electrical connection between said transceiver circuitry and a connector on said portable antenna via a capacitive coupling when said antenna is retracted within said portable communication device to electrically connect said transceiver circuitry to an external antenna connected to said portable antenna connector.

18. The method of claim 17, wherein said portable antenna connection establishing step comprises the steps of:

using an antenna coil in said portable antenna as a coil antenna when said external antenna is not connected to said transceiver circuitry; and using said antenna coil as an antenna load when said external antenna is connected to said transceiver circuitry.

* * * * *